US009044133B1

(12) United States Patent
Million

(10) Patent No.: US 9,044,133 B1
(45) Date of Patent: Jun. 2, 2015

(54) DEBRIS CLEANING SYSTEM

(76) Inventor: Karen K. Million, Wasilla, AK (US)

( * ) Notice: Subject to any disclaimer, the term of this patent is extended or adjusted under 35 U.S.C. 154(b) by 436 days.

(21) Appl. No.: 13/241,648

(22) Filed: Sep. 23, 2011

(51) Int. Cl.

| | |
|---|---|
| ***A47L 13/00*** | (2006.01) |
| ***A47L 13/40*** | (2006.01) |
| ***A47L 13/41*** | (2006.01) |
| ***A47L 13/10*** | (2006.01) |
| ***A47L 13/12*** | (2006.01) |

(52) U.S. Cl.
CPC *A47L 13/40* (2013.01); *A47L 13/41* (2013.01)

(58) Field of Classification Search
None
See application file for complete search history.

(56) References Cited

U.S. PATENT DOCUMENTS

| | | | | |
|---|---|---|---|---|
| 899,726 | A | 9/1908 | Goodier | |
| 1,132,658 | A | 3/1915 | Harrison | |
| 1,903,896 | A | 4/1933 | Greenberg | |
| 1,952,769 | A | 3/1934 | Mess | |
| 3,377,641 | A | 4/1968 | McGregor | |
| 3,991,432 | A | 11/1976 | Griffin | |
| 4,170,803 | A | 10/1979 | Saito | |
| D323,727 | S | 2/1992 | Re | |
| 5,281,306 | A * | 1/1994 | Kakiuchi et al. | 162/158 |
| 5,487,202 | A | 1/1996 | Cowan | |
| 5,701,630 | A | 12/1997 | Liao | |
| 6,113,169 | A | 9/2000 | Gohman | |
| 6,766,552 | B1 | 7/2004 | Policicchio | |
| 6,814,519 | B2 | 11/2004 | Policicchio | |
| 7,007,338 | B2 * | 3/2006 | Garabedian et al. | 15/231 |
| 7,013,528 | B2 | 3/2006 | Parker | |
| D527,858 | S | 9/2006 | Van Cleave | |
| 7,163,349 | B2 | 1/2007 | Policicchio | |
| 7,743,455 | B2 * | 6/2010 | Rothweil et al. | 15/231 |
| 2006/0016030 | A1 | 1/2006 | Rothweil | |
| 2007/0169709 | A1 * | 7/2007 | Wang et al. | 119/173 |

OTHER PUBLICATIONS http://www.magnetsource.com/Consumer%20Pages/Sweepers.html; Master Magnetics, Inc.; Aug. 12, 2010.
http://www.walgreens.com/store/catalog/Cleaners/WetJet-All-In-One-Power-Mop/ID=prod379767-product?V=G&ec=frgl_&ci_src=14110944&ci_sku=sku379768; Walgreens; Aug. 12, 2010.
http://www.1stergo.com/pc_findustmopssyntheticng/GSC21236.html; 1st Ergo; Aug. 12, 2010.
www.homedepot.com/webapp/wcs/stores/servlet/ProductDisplaystoreId=10051&productId=100660513&langId=-1&catalogId=10053&ci_sku=100660513&ci_src=14110944 . . . ; Home Depot; Aug. 12, 2010.

* cited by examiner

*Primary Examiner* — Monica Carter
*Assistant Examiner* — Stephanie Berry
(74) *Attorney, Agent, or Firm* — Neustel Law Offices

(57) ABSTRACT

A debris cleaning system for safely and efficiently cleaning debris such as broken glass from a variety of surfaces. The debris cleaning system generally includes a plurality of magnets which extend out of both its upper and lower ends and an absorption material covers its lower end. The adhesion member is secured to the housing through interaction of the magnets with metallic strips on the lower end of the housing. The adhesion composition, which includes a metallic component, is sprayed onto the debris to be cleaned. The housing is then utilized to run the adhesion member over the debris, wherein the absorption material and magnets act to attract and retain the coated debris to the adhesion member for disposal.

10 Claims, 5 Drawing Sheets

DEBRIS CLEANING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a debris cleaning system and more specifically it relates to a debris cleaning system for safely and efficiently cleaning debris such as broken glass from a variety of surfaces.

2. Description of the Related Art

Any discussion of the related art throughout the specification should in no way be considered as an admission that such related art is widely known or forms part of common general knowledge in the field.

Hard particulate debris such as broken glass has been known to be difficult to clean from a surface such as a floor. Generally, when cleaning such debris, a broom and dustpan must be utilized, wherein the broom brushes the debris into the dustpan for disposal. However, this method is not efficient in picking up all pieces of debris. Further, shards of glass or other debris can become stuck in the bristles of the brush. Vacuum cleaners are known to incur mechanical failure when used to clean hard, particulate debris such as glass. Mechanical sweepers have suffered from similar shortcomings, either becoming clogged and non-functional or failing to properly clean the area of the debris.

Because of the inherent problems with the related art, there is a need for a new and improved debris cleaning system for safely and efficiently cleaning debris such as broken glass from a variety of surfaces.

BRIEF SUMMARY OF THE INVENTION

The invention generally relates to a debris cleaning system which includes a housing, an adhesion member and an adhesion composition. The adhesion member includes a plurality of magnets which extend out of both its upper and lower ends and an absorption material covers its lower end. The adhesion member is secured to the housing through interaction of the magnets with metallic strips on the lower end of the housing. The adhesion composition, which includes a metallic component, is sprayed onto the debris to be cleaned. The housing is then utilized to run the adhesion member over the debris, wherein the absorption material and magnets act to attract and retain the coated debris to the adhesion member for disposal.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
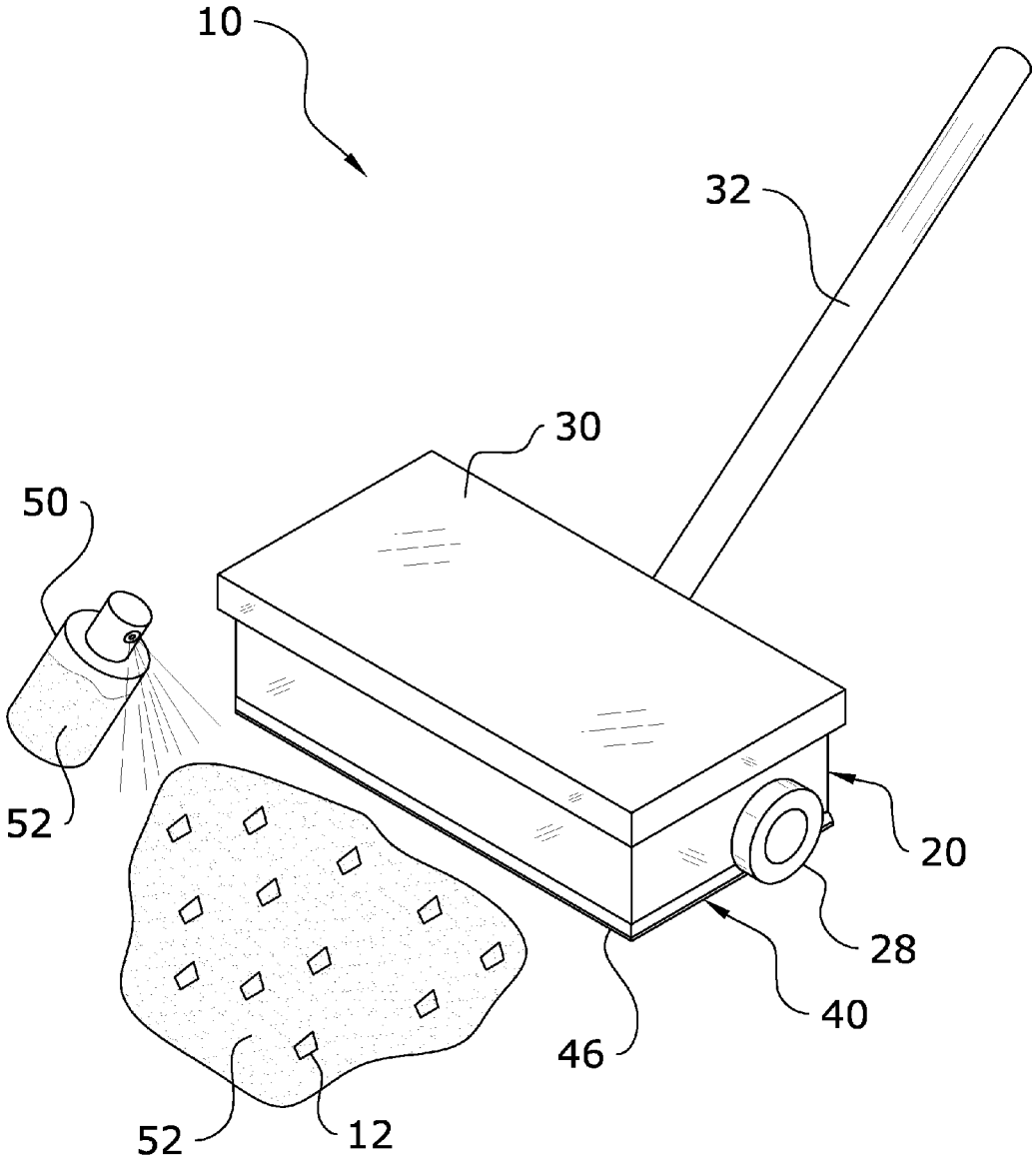
FIG. 1 is an upper perspective view of the present invention in use.

Turning now descriptively to the drawings, in which similar reference characters denote similar elements throughout the several views, FIGS. 1 through 5 illustrate a debris cleaning system 10, which comprises a housing 20, an adhesion member 40 and an adhesion composition 52. The adhesion member 40 includes a plurality of magnets 44 which extend out of both its upper and lower ends 42, 43 and an absorption material 46 covers its lower end 43. The adhesion member 40 is secured to the housing 20 through interaction of the magnets 44 with metallic strips 25, 26 on the lower end 24 of the housing 20. The adhesion composition 52, which includes a metallic component, is sprayed onto the debris 12 to be cleaned. The housing 20 is then utilized to run the adhesion member 40 over the debris 12, wherein the absorption material 46 and magnets 44 act to attract and retain the coated debris 12 to the adhesion member 40 for disposal.

B. Housing

The present invention will generally include a housing 20 to which the adhesion member 40 of the present invention will be attached. The housing 20 may also be utilized to store additional adhesion members 40. The housing 20 will generally be comprised of a structure having a first side 21, a second side 22, an upper end 23 and a lower end 24. The housing 20 may be comprised of various structures and designs, but will preferably be comprised of a substantially rectangular structure as shown in FIG. 1.

Figure 2:
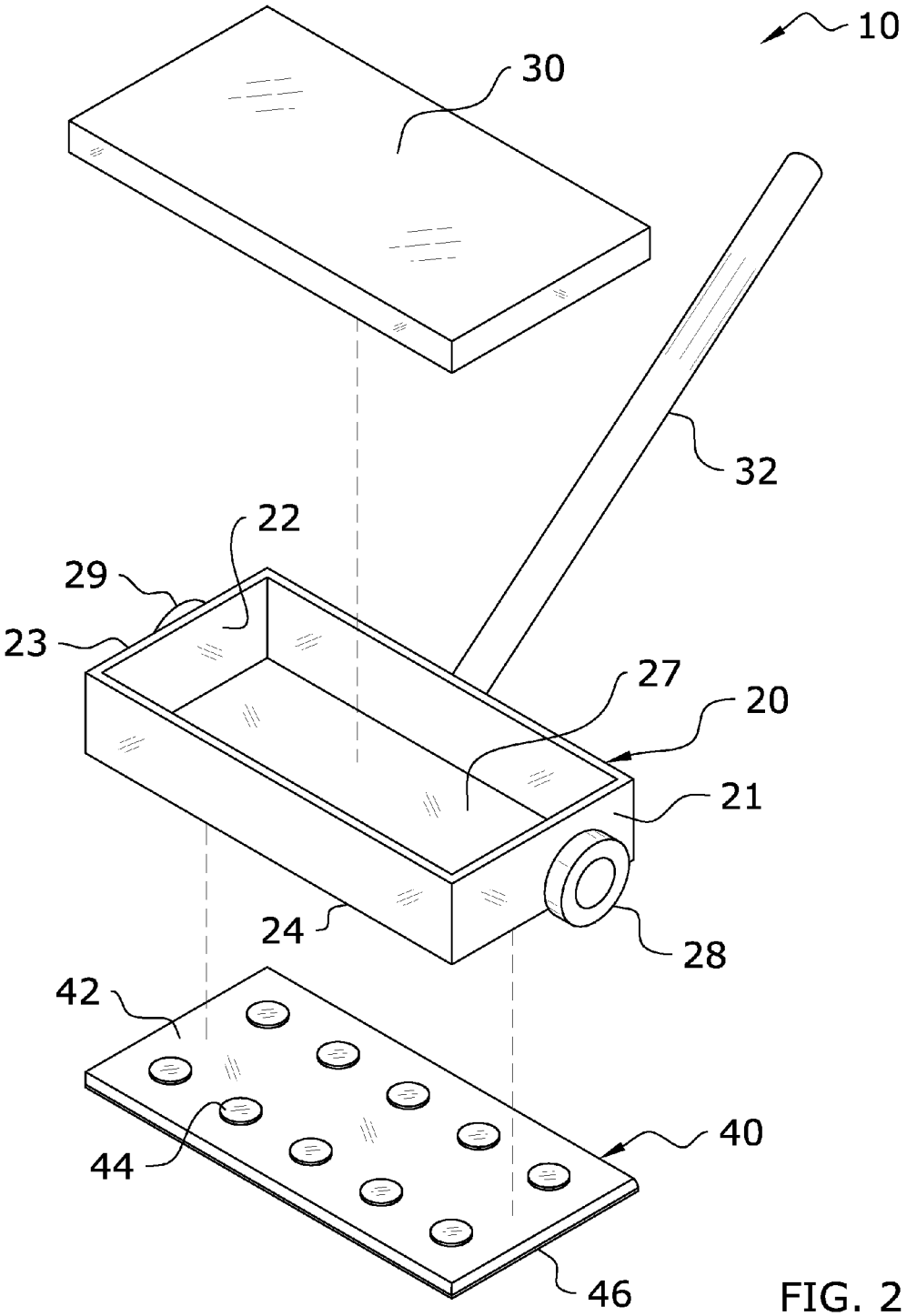
FIG. 2 is an exploded upper perspective view of the present invention.

The housing 20 will generally include a storage area 27 which is accessible through the upper end 23 of the housing 20. When not in use, a lid 30 is provided to cover the storage area 27 and protect any items stored therein. The lid 30 may be comprised of various structures, but will preferably be comprised of substantially the same shape as the upper end 23 of the housing 20. The lid 30 will generally be secured to the upper end 23 of the housing 20 to enclose its storage area 27 as shown in FIG. 2.

The housing 20 will also generally include a handle 32 extending therefrom for use in advancing the housing 20 (and attached adhesion member 40) across a surface when in use. The handle 32 may be comprised of various structures, but will preferably be comprised of an elongated member which is movably attached to the housing 20 as shown in FIG. 1. In some embodiments, however, the handle 32 will be fixedly attached to the housing 20. The handle 32 may also be comprised of various lengths to assist with different applications.

The housing 20 will also generally include at least one wheel 28, 29 to allow the housing 20 to traverse the surface being cleaned of debris 12. Different types and numbers of wheels 28, 29 may be utilized so long as the housing 20 is freely movable over a surface. In a preferred embodiment as shown in FIG. 3, a first wheel 28 will be positioned on a first side 21 of the housing 20 and a second wheel 29 will be positioned on a second side 22 of the housing 20.

Figure 3:
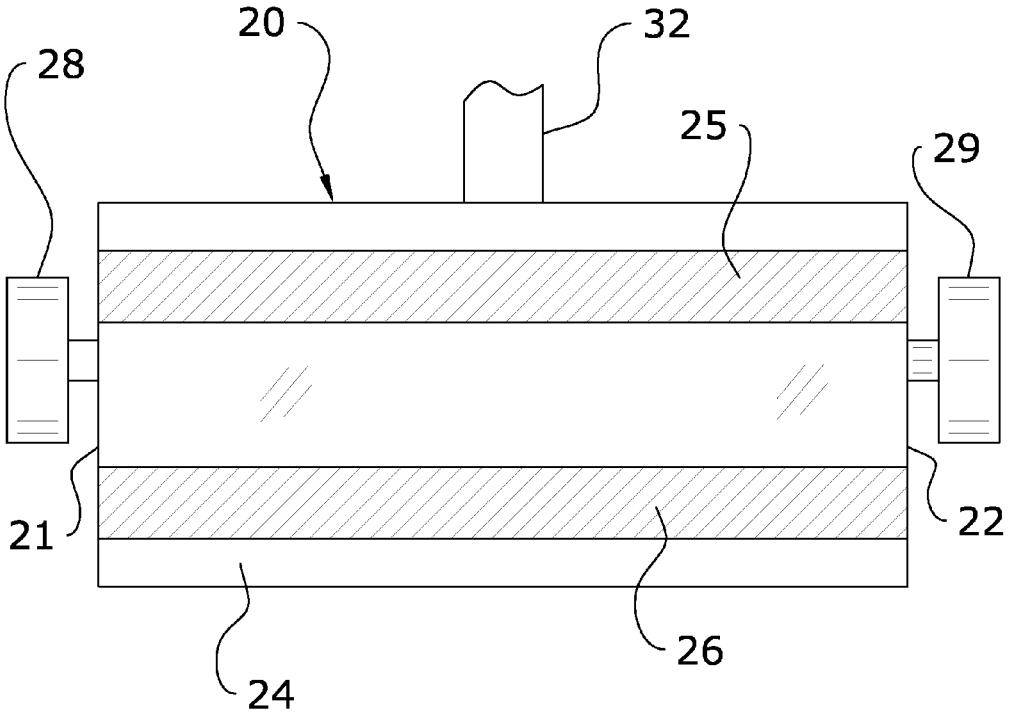
FIG. 3 is a bottom view of the housing of the present invention.

The housing 20 will generally include at least one metallic strip 25, 26 positioned on its lower end 24 as shown in FIG. 3. The metallic strips 25, 26 are utilized to removably secure the adhesion member 40 of the present invention to the housing 20 for use. Varying numbers of metallic strips 25, 26 may be utilized. Further, other means of removable attachment may be utilized in alternate embodiments, including strips of adhesive material and the like which would allow the adhesion member 40 to be removably secured to the lower end 24 of the housing 20.

In a preferred embodiment, a first metallic strip 25 will extend across the lower end 24 of the housing 20 from its first side 21 to its second side 22 and a second metallic strip 26 will extend parallel to the first metallic strip 25 across the lower end 24 of the housing 20 from its first side 21 to its second side 22. It is also appreciated that, in some embodiments, the metallic strips 25, 26 may be comprised of a row of individual areas of metallic material instead of a continuous strip.

C. Adhesion Member

The present invention will generally utilize an adhesion member 40 for collecting debris 12 such as glass from a surface. The adhesion member 40 will generally be removably secured to the lower end 24 of the housing 20 when in use. Because the adhesion member 40 will generally be disposable, multiple adhesion members 40 are generally provided with those which are not in use being stored within the storage area 27 of the housing 20.

Figure 4:
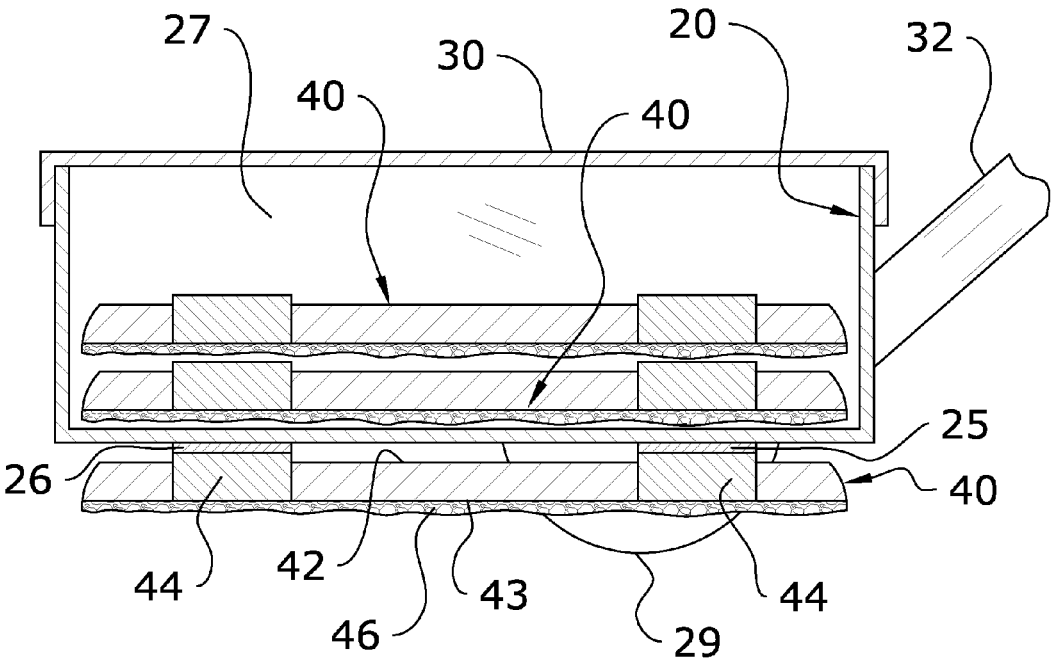
FIG. 4 is a side sectional view of the present invention with extra adhesion members stored in the housing.
Figure 5:
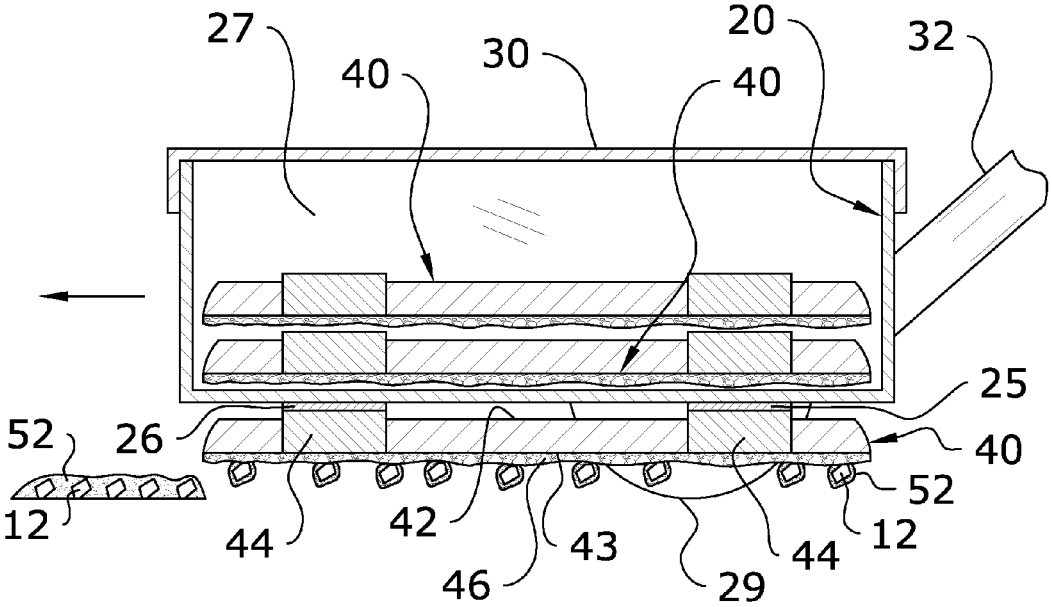
FIG. 5 is a side sectional view of the present invention in use.

The adhesion member 40 of the present invention will generally be comprised of a substantially flat, rectangular member having an upper end 42 and a lower end 43 as shown in FIGS. 2 and 4. However, it is appreciated that other shapes may be utilized for the adhesion member 40 in alternate embodiments. Generally, the shape of the adhesion member 40 will substantially match that of the housing 20.

The adhesion member 40 will generally include a plurality of magnets 44. Each of the magnets 44 will generally extend through both the upper end 42 and the lower end 43 of the adhesion member 40. The magnets 44 are utilized from the upper end 42 of the adhesion member 40 to secure the adhesion member 40 to the housing 20 through magnetic interaction with the metallic strips 25, 26 on the lower end 24 of the housing 20 as shown in FIG. 4. The magnets 44 are utilized from the lower end 43 of the adhesion member 40 to attract the debris 12 being picked up with the present invention after it has been coated with the adhesion composition 52.

Various numbers, sizes and configurations of magnets 44 may be utilized and the present invention should not be construed as being limited to the configuration shown in the figures. In a preferred embodiment, a first row of individual magnets 44 will extend across the length of the adhesion member 40 to match the first metallic strip 25 of the housing 20 and a second row of individual magnets 44 will extend parallel to the first row to match the second metallic strip 26 of the housing 20.

The lower end 43 of the adhesion member 40 will also generally include an absorption material 46 positioned thereon in a manner which covers the lower end 43 of the adhesion member 40 and the lower end of the magnets 44 as shown in FIG. 4. The absorption material 46 will generally be comprised of a cotton-like substance which acts to absorb any liquid from the adhesion composition 52 which coats the debris 12 as it is being picked up by the present invention. While various materials having absorptive properties may be utilized, in a preferred embodiment the absorption material 52 is comprised of sodium polyacrylate.

D. Spray Bottle

The present invention will also generally include a spray bottle 50 or other container holding an adhesion composition 52. While the figures illustrate the use of a spray bottle 50, it is appreciated that any container capable of storing and dispensing a liquid may be utilized.

The adhesion composition 52 will generally be sprayed or dispensed onto the debris 12 to be picked up. The adhesion composition 52 will generally be comprised of an evaporative component, an adhesive component and a metallic component. The evaporative component of the adhesion composition 52 is utilized to ensure that the liquid portion of the adhesion composition 52 quickly evaporates after application to the debris 12. The adhesive component ensures that the metallic component of the composition 52 sticks to the debris 12 and the metallic component is utilized so that the coated debris 12 may be picked up by the magnets 44 of the adhesion member 40.

The evaporative component of the adhesion composition 52 may be comprised of any type of liquid which acts to evaporate quickly in ambient conditions. Preferably, an alcohol-based fluid will be utilized for the evaporative component. More specifically, in a preferred embodiment, wood alcohol may be utilized.

The adhesive component of the adhesion composition 52 may be comprised of any type of liquid which will leave a sticky residue to which the metallic component may adhere after the evaporative component has evaporated. Preferably, a sugar-based fluid will be utilized for the adhesive component. More specifically, in a preferred embodiment, grape juice such as white grape juice may be utilized.

The metallic component of the adhesion composition 52 may be comprised of any metal which will be attracted by the magnets 44. Generally, small shards, slivers or grains of the metallic component will be mixed in with the adhesion composition 52 so that, when the composition 52 is dispensed, the metallic component will coat and adhere to the debris 12 to be picked up by the present invention. Any type of metal may be utilized, though a preferred embodiment will utilize a low-cost metal such as iron or cobalt.

E. Operation of Preferred Embodiment

In use, an adhesion member 40 is removed from the storage area 27 of the housing 20 and attached to the lower end 24 thereof through aligning the magnets 44 protruding from the upper end 42 of the adhesion member 40 with the metallic strips 25, 26 positioned on the lower end 24 of the housing 20. The spray bottle 50 is then shaken to ensure proper mixing of the different components of the adhesion composition 52, and then the adhesion composition 52 is applied to the debris 12 to be picked up. The metallic component of the adhesion composition 52 will stick to the debris 12 with the assistance of the adhesive component.

The housing 20 and attached adhesion member 40 are then run over the composition 52 coated debris 12. The debris 12, which is coated with the metallic component of the adhesion composition 52, will be magnetically attracted to and held by the magnets 44 protruding from the lower end 43 of the adhesion member 40. The absorption material 46 will act to absorb any remaining liquid and act to hold the debris 12 therein.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A debris cleaning system, comprising:

a housing, wherein said housing includes an upper end and a lower end;

an adhesion composition for coating debris, wherein said adhesion composition includes a metallic component, wherein said adhesion composition is further comprised of an evaporative component and an adhesive component, wherein said metallic component is comprised of grains of a metal material mixed with said adhesion composition, wherein said metal material is comprised of iron;

an adhesion member for attracting coated debris, wherein said adhesion member is removably attached to said lower end of said housing, wherein said adhesion member includes at least one magnet; and an absorption material fixedly attached to a lower end of said adhesion member.

2. The debris cleaning system of claim 1, wherein said housing includes a storage area.

3. The debris cleaning system of claim 2, wherein said housing includes a removable lid.

4. The debris cleaning system of claim 1, wherein said housing includes a handle.

5. The debris cleaning system of claim 1, wherein said housing includes at least one wheel.

6. The debris cleaning system of claim 1, wherein said absorption material is comprised of sodium polyacrylate.

7. The debris cleaning system of claim 1, wherein said evaporative component is comprised of alcohol.

8. The debris cleaning system of claim 1, wherein said adhesive component is comprised of a sugar-based liquid.

9. The debris cleaning system of claim 1, further comprising a spray bottle, wherein said adhesion composition is stored and dispensed from said spray bottle.

10. A debris cleaning system, comprising:

a housing, wherein said housing includes an upper end and a lower end;

an adhesion composition for coating debris, wherein said adhesion composition includes a metallic component, wherein said adhesion composition is further comprised of an evaporative component and an adhesive component, wherein said metallic component is comprised of grains of a metal material mixed with said adhesion composition, wherein said metal material is comprised of cobalt;

an adhesion member for attracting coated debris, wherein said adhesion member is removably attached to said lower end of said housing, wherein said adhesion member includes at least one magnet; and an absorption material fixedly attached to a lower end of said adhesion member.

* * * * *